US009933161B1

(12) United States Patent
Papple

(10) Patent No.: US 9,933,161 B1
(45) **Date of Patent: *Apr. 3, 2018**

(54) COMBUSTOR DOME HEAT SHIELD

(71) Applicant: Pratt & Whitney Canada Corp., Longueuil (CA)

(72) Inventor: Michael Papple, Verdun (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 480 days.

This patent is subject to a terminal disclaimer.

(21) Appl. No.: 14/620,612

(22) Filed: Feb. 12, 2015

(51) Int. Cl.

| | |
|---|---|
| ***F23R 3/00*** | (2006.01) |
| ***F23R 3/10*** | (2006.01) |
| ***F23R 3/16*** | (2006.01) |
| ***F23R 3/28*** | (2006.01) |
| ***F23R 3/60*** | (2006.01) |
| *F23R 3/26* | (2006.01) |

(52) U.S. Cl.
CPC ..... *F23R 3/10* (2013.01); *F23R 3/002* (2013.01); *F23R 3/16* (2013.01); *F23R 3/26* (2013.01)

(58) Field of Classification Search
None
See application file for complete search history.

(56) References Cited

U.S. PATENT DOCUMENTS 4,934,145 A * 6/1990 Zeisser ..... F23R 3/283 60/740
5,239,832 A * 8/1993 Koshoffer ..... F23R 3/283 60/740
5,271,219 A * 12/1993 Richardson ..... F23R 3/10 60/39.11
5,396,759 A * 3/1995 Richardson ..... F23R 3/002 60/756
5,577,379 A 11/1996 Johnson
5,894,732 A * 4/1999 Kwan ..... F23R 3/10 60/748
5,956,955 A * 9/1999 Schmid ..... F23R 3/10 60/748
6,155,056 A * 12/2000 Sampath ..... F23R 3/002 60/756
6,412,272 B1 * 7/2002 Titterton, III ..... F23R 3/283 60/39.37
7,478,534 B2 1/2009 Guezengar et al.
7,681,398 B2 3/2010 Patel et al.
7,690,207 B2 4/2010 Markarian et al.
(Continued)

*Primary Examiner* — Ehud Gartenberg
*Assistant Examiner* — Stephanie Cheng
(74) *Attorney, Agent, or Firm* — Norton Rose Fulbright Canada LLP

(57) ABSTRACT

A combustor dome heat shield has a heat shield panel adapted to be mounted to a combustor dome with a back face of the heat shield panel in spaced-apart facing relationship with an inner surface of the combustor dome to define an air gap between the heat shield panel and the combustor dome. Rails extend from the back face of the heat shield panel across the air gap. An anti-rotation notch is defined in at least one of the rails for receiving an anti-rotation tab of an adjacent element, such as a fuel nozzle floating collar. The rails include notch cavity rails extending on either side of the anti-rotation notch. The notch cavity rails define a notch cavity for capturing coolant air leaking through the anti-rotation notch.

15 Claims, 7 Drawing Sheets

(56) References Cited

U.S. PATENT DOCUMENTS 7,721,548 B2 * 5/2010 Patel ..... F23R 3/10 60/752
7,748,221 B2 7/2010 Patel et al.
7,827,800 B2 * 11/2010 Stastny ..... F23R 3/002 60/39.11
7,926,280 B2 4/2011 Morenko et al.
8,701,417 B2 * 4/2014 Nicholls ..... F23R 3/10 60/756
2002/0178734 A1 * 12/2002 Stastny ..... F23R 3/283 60/796
2004/0112061 A1 * 6/2004 Oskooei ..... F23R 3/12 60/776
2005/0034459 A1 * 2/2005 McMasters ..... F23R 3/002 60/752
2007/0028620 A1 * 2/2007 McMasters ..... F23R 3/286 60/748
2007/0193273 A1 * 8/2007 DeVane ..... F23R 3/002 60/752
2008/0016874 A1 * 1/2008 Markarian ..... F23R 3/002 60/772
2008/0115499 A1 * 5/2008 Patel ..... F23R 3/10 60/752
2008/0115506 A1 * 5/2008 Patel ..... F02C 3/145 60/804
2008/0202122 A1 * 8/2008 Guezengar ..... F23R 3/14 60/722
2008/0282703 A1 * 11/2008 Morenko ..... F23R 3/002 60/796
2008/0314044 A1 * 12/2008 Bronson ..... F23R 3/00 60/754
2009/0000303 A1 * 1/2009 Patel ..... F23R 3/002 60/752
2011/0000216 A1 * 1/2011 Imamura ..... F23R 3/14 60/748
2013/0004906 A1 * 1/2013 Brown ..... F23R 3/14 431/354
2013/0199194 A1 * 8/2013 Carlisle ..... F23R 3/002 60/772

* cited by examiner

COMBUSTOR DOME HEAT SHIELD

TECHNICAL FIELD

The application relates generally to gas turbine engine combustors and, more particularly, to combustor dome heat shields.

BACKGROUND OF THE ART

Heat shields such as those used to protect the combustor shells, are exposed to hot gases in the primary combustion zone. The amount of coolant available for cooling the heat shields must be minimized to improve the combustion efficiency and to reduce the smoke, unburned hydrocarbon and CO/NOx emission.

There is a continuing need for improved heat shields and targeted cooling schemes.

SUMMARY

In one aspect, there is provided a dome heat shield for a combustor of a gas turbine engine, comprising a heat shield panel adapted to be mounted to a combustor dome with a back face of the heat shield panel in spaced-apart facing relationship with an inner surface of the combustor dome to define an air gap between the heat shield panel and the combustor dome, rails extending from the back face of the heat shield panel across the air gap, and at least one anti-rotation notch defined in a first rail of said rails for receiving an anti-rotation tab of an adjacent element, the rails further including notch cavity rails extending from the first rail on either side of the at least one anti-rotation notch, the notch cavity rails defining a notch cavity in fluid flow communication with the anti-rotation notch.

In a second aspect, there is provided a gas turbine engine combustor comprising: a shell having a dome, at least one dome heat shield mounted to an inner surface of the dome, at least one fuel nozzle opening defined in the dome heat shield, at least one fuel nozzle component, such as a floating collar, mounted to the dome, the fuel nozzle component having an anti-rotation tab engaged in an anti-rotation notch defined in a first rail extending from a back face of the dome heat shield, the anti-rotation notch leading to a notch cavity defined on the back face of the dome heat shield by notch cavity rails extending from the first rail.

DESCRIPTION OF THE DRAWINGS

Reference is now made to the accompanying figures, in which.

DETAILED DESCRIPTION

Figure 1:
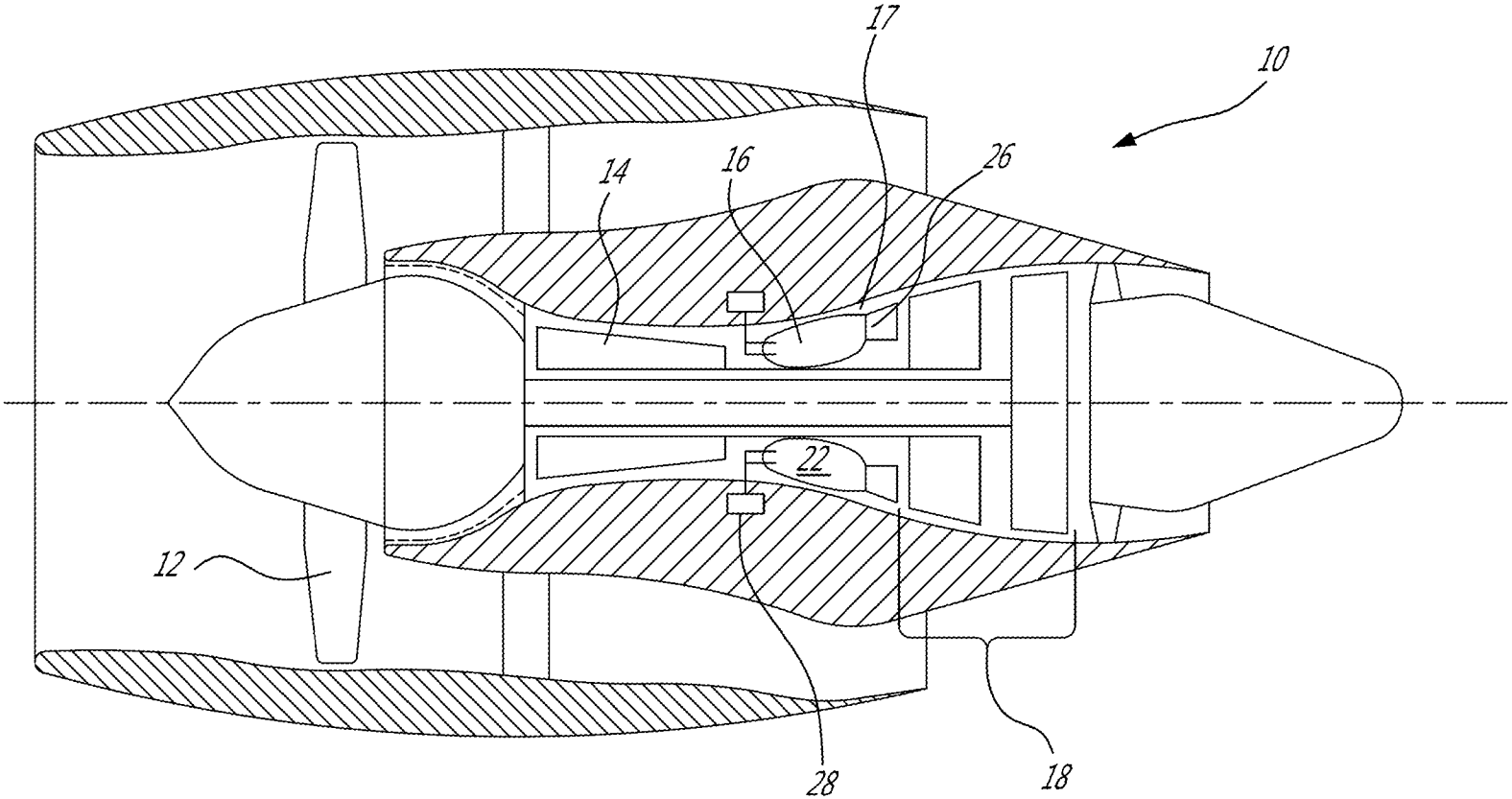
FIG. 1 is a schematic cross-section view of a turbofan engine having a reverse flow annular combustor and dome heat shields.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

The combustor 16 is housed in a plenum 17 supplied with compressed air from compressor 14. The combustor 16 comprise an annular combustor shell 20 including a radially inner shell 20*a* and a radially outer shell 20*b*, defining a combustion chamber 22. While the illustrated combustor is a flow-through combustor, it is understood that it could also take the form of a reverse-flow combustor or any other type of gas turbine engine combustors. The combustor 16 has a bulkhead or inlet dome portion 24. The combustor 16 further has an exit portion 26 for communicating combustion gases with the turbine section 18. A plurality of circumferentially distributed fuel nozzles 28 are mounted to extend through the dome portion 24 of the combustor 20 to deliver a fuel-air mixture to the combustion chamber 22.

A plurality of impingement holes 29 (see FIG. 3) are defined in the inner and outer shells 20*a* and 20*b* for cooling purposes, and dilution holes (not shown) may also be provided for combustion purposes. It is understood that the inner and outer shells 20*a* and 20*b* may adopt various configurations. The inner and outer shells 20*a* and 20*b* are typically made out of sheet metal, though any suitable material(s) and manufacturing method(s) may be used. Heat shields, such as inner front heat shield 82 an outer front heat shield 84 shown in FIG. 2, may be mounted to the hot inner surface of the combustor shell 20. A thermal barrier coating (not shown) may be applied to the inner or combustion facing surfaces of the inner and outer front heat shields 82 and 84 to protect them against the high temperatures prevailing in the combustion chamber 22.

Figure 2:
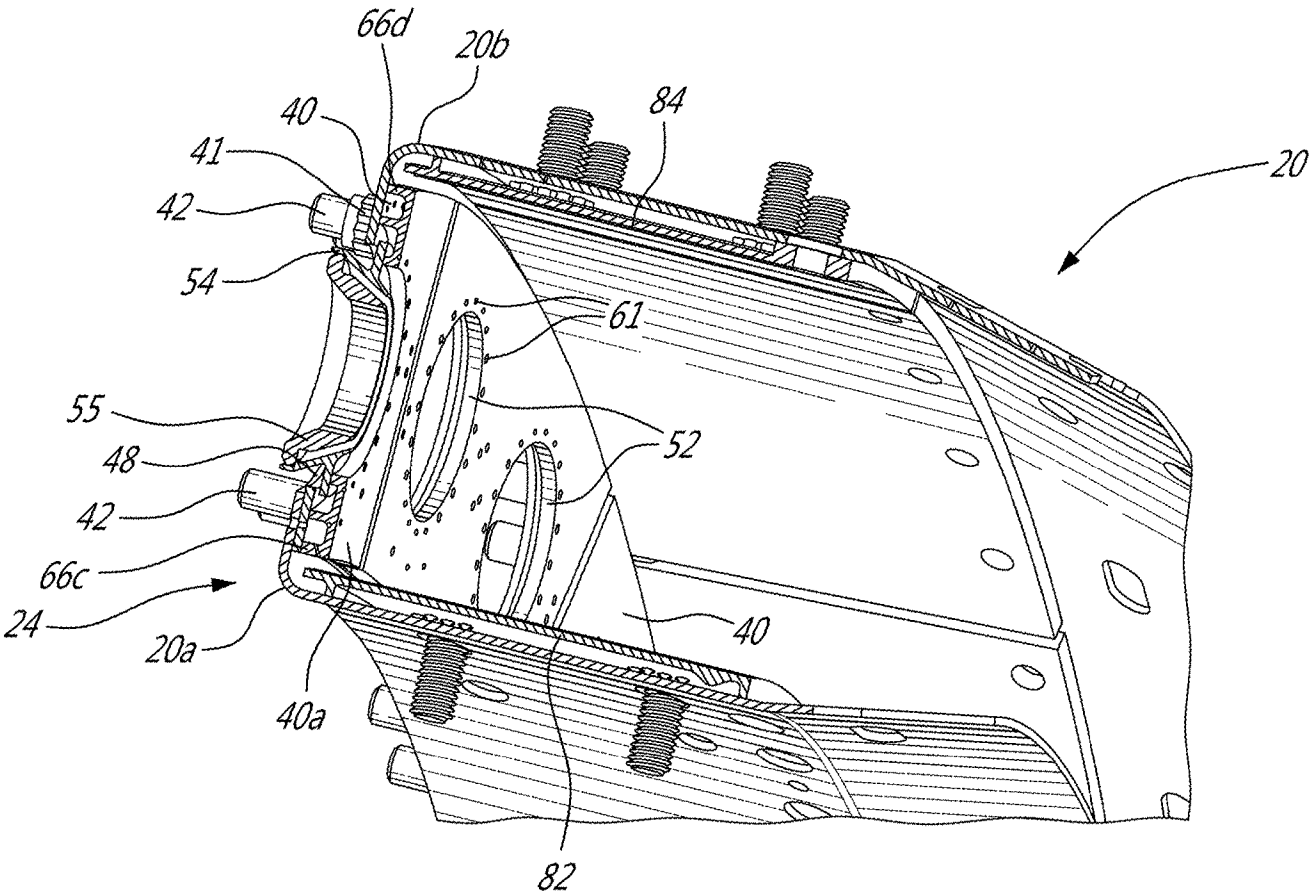
FIG. 2 is an isometric view of a dome portion of the combustor of the engine shown in FIG. 1.
Figure 3:
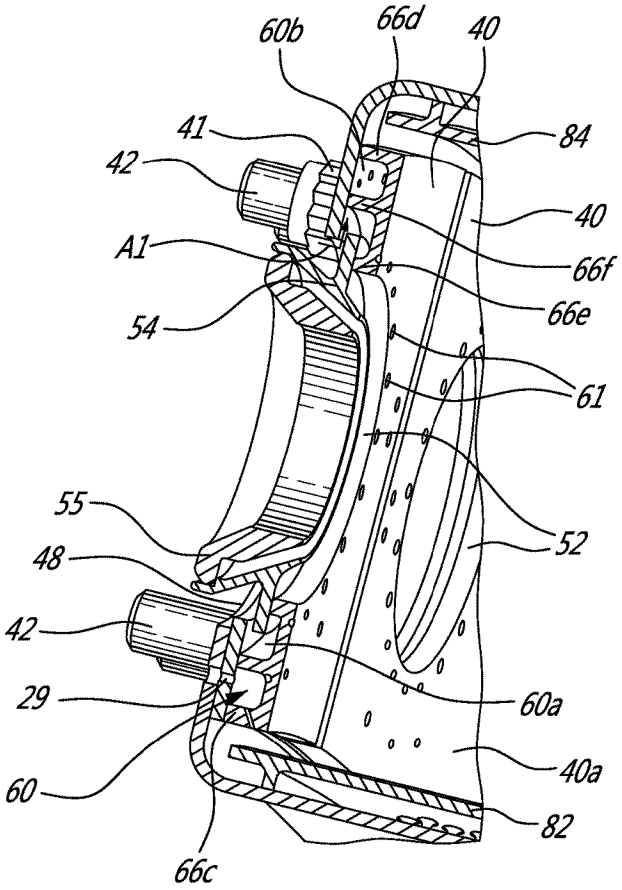
FIG. 3 is an enlarged isometric view of the dome portion of the combustor shown in FIG. 2 and illustrating the assembly of a dome heat shield to the radially inner and outer shells of the combustor.

Referring concurrently to FIGS. 2 and 3, it can be appreciated that circumferentially distributed dome heat shields 40 may be mounted to the dome portion 24 of the inner and outer shells 20*a*, 20*b* inside the combustion chamber 22 to protect the dome portion 24 from the high temperatures in the combustion chamber 22. The dome heat shields 40 are typically castings made out of high temperature capable materials. Each dome heat shield 40 has a plurality of threaded studs 42 (six according to the examples shown in FIGS. 4, 5 and 7) extending from a back face of the heat shield and through corresponding mounting holes (not shown) defined in the combustor dome. Self-locking nuts 41 are threadably engaged on the studs 42 from outside of the combustion chamber 22 for holding the dome heat shields 40 tightly against the combustor dome.

As shown in FIGS. 2 and 3, circumferentially spaced-apart fuel nozzle openings 48 are defined through the combustor dome portion 24 for allowing mounting of the fuel nozzles 28 to the combustor 16. At least one corresponding fuel nozzle opening 52 (two in the examples illustrated in FIGS. 2-7) is defined in each of the dome heat shields 40 and is aligned with a corresponding fuel nozzle opening 48 in the combustor dome portion 24 for accommodating an associated fuel nozzle therein. The provision of two or more fuel nozzle openings 52 in each heat shield 40 reduces the number of heat shields required to cover the dome portion 24, the number of studs 42, rails, air coolant leakage, cost and weight when compared to dome heat shields for a single fuel nozzle. However, it is understood that the features of the present disclosure are equally applicable to dome heat shield segments having a single fuel nozzle opening.

Figure 4:
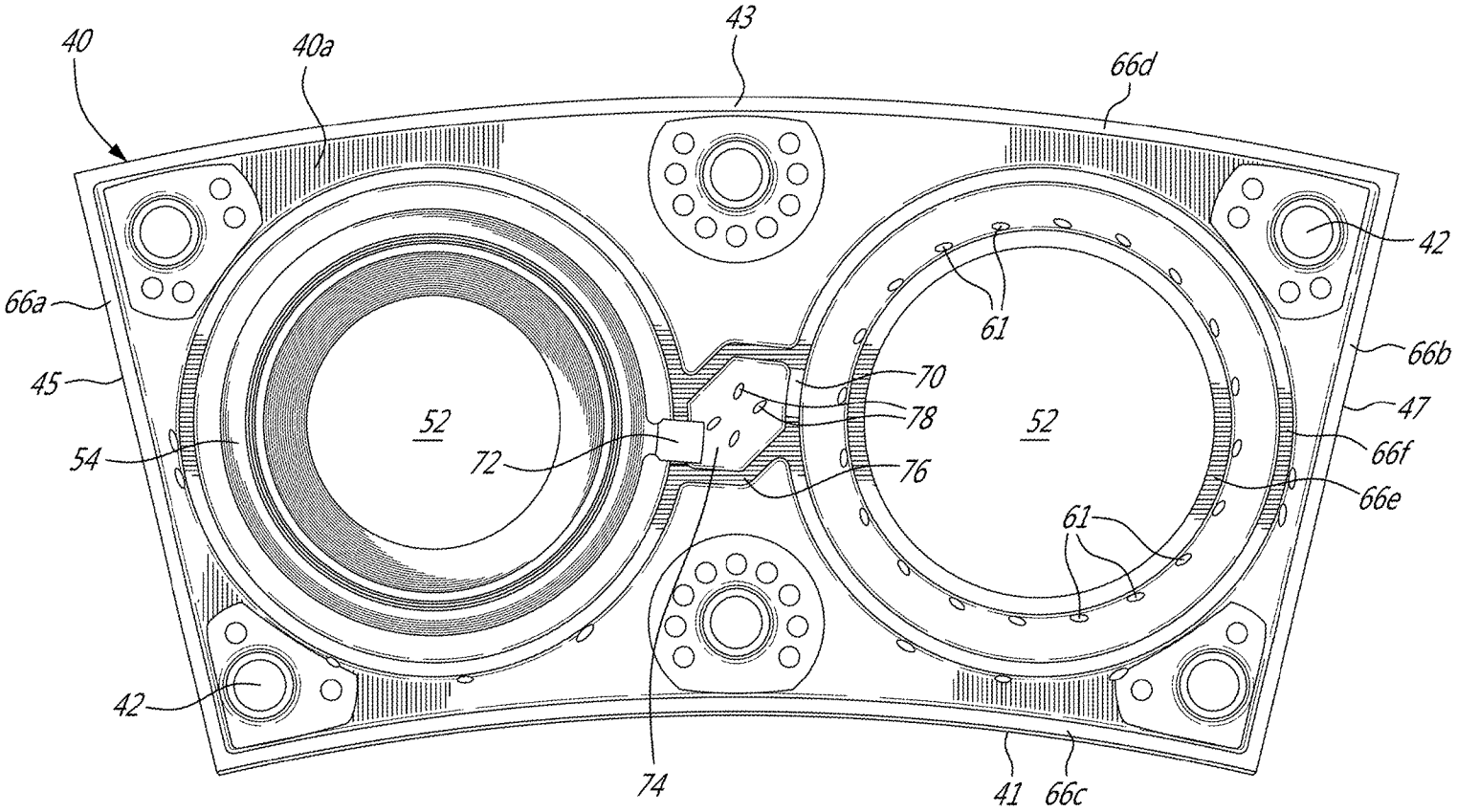
FIG. 4 is a rear view of the dome heat shield shown in FIG. 3 and illustrating the engagement of an anti-rotation tab of a fuel nozzle floating collar in a corresponding anti-rotation notch defined in an outer ring projecting from the back face of the dome heat shield.

As can be appreciated from FIGS. 2-4, a floating collar 54 is mounted in each nozzle opening 48 to provide sealing between the combustor shell 20 and the fuel nozzles 28 while allowing relative movement therebetween. The fuel nozzle collars 55 of the nozzles 28 are slidably received in the floating collars 54. The floating collars 54 are axially trapped between the dome heat shields 40 and the dome portion 24 of the inner and outer combustor shells 20*a*, 20*b*. The fuel nozzle openings 48 are slightly oversized relative to the floating collars 54, thereby allowing limited radial movement of the collars 54 with the fuel nozzles 28 relative to the combustor shell 20.

As shown in FIG. 3, the dome heat shields 40 are spaced from the dome portion 24 so as to define a heat shield back face cooling air space or air gap 60. Relatively cool air from plenum 17 is admitted in the air gap 60. Impingement hole patterns are arranged in the dome portion 24 of the combustor shell 20 to optimize the heat shield cooling. As will be seen hereinafter, heat exchange promoting structures and rails may be strategically positioned on the back face of the heat shields 40 to locally promote enhance cooling in targeted or most thermally solicited areas of the heat shields.

Figure 5:
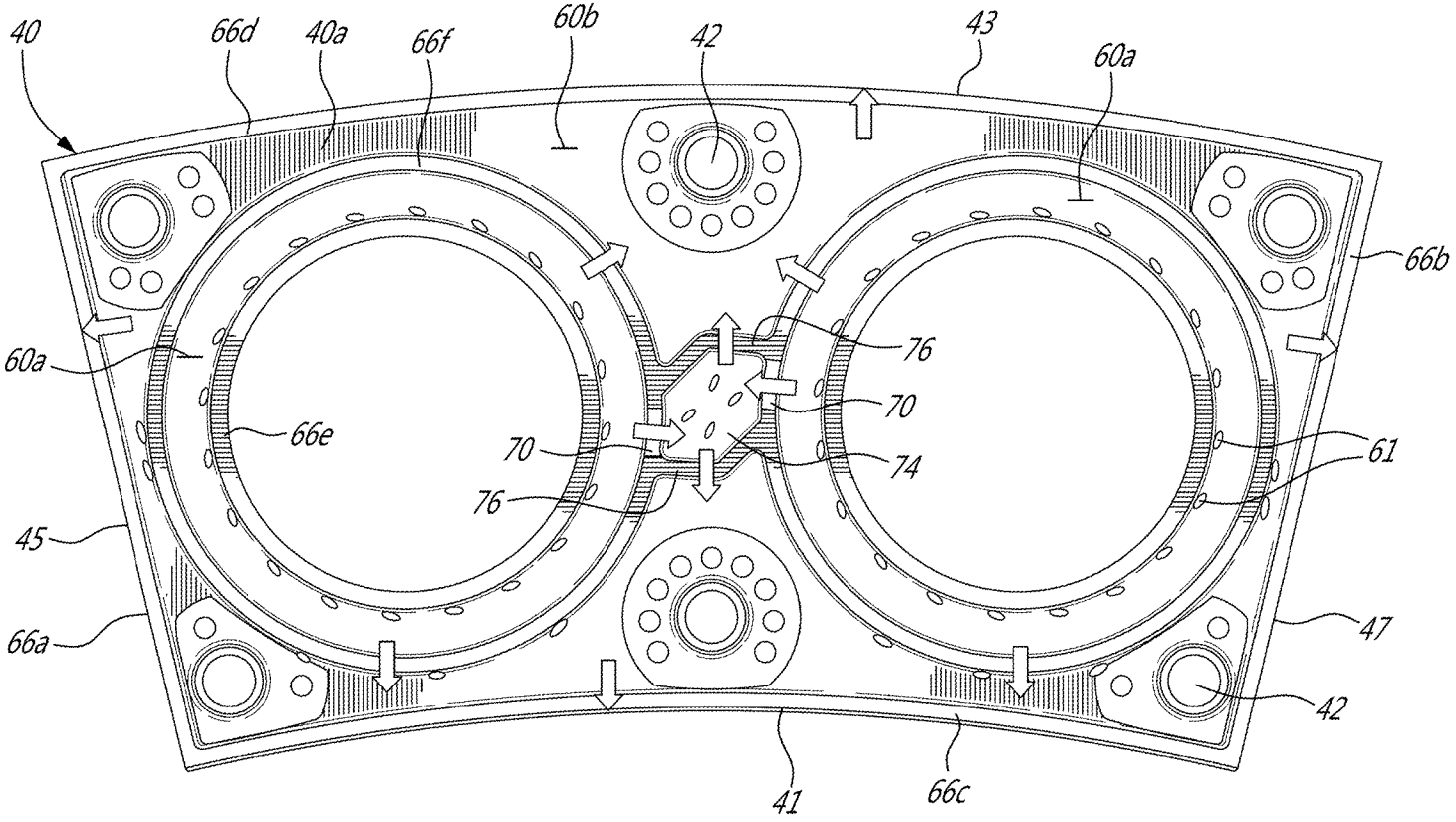
FIG. 5 is a rear view of the dome heat shield and schematically illustrating coolant air leaking over the top of the rails on the back face of the dome heat shield.

Now referring concurrently to FIGS. 4 and 5, it can be seen that each individual heat shield 40 may be provided in the form of a panel 40*a*, more particularly a circular sector, having radially inner and outer edges 41, 43 extending between lateral edges 45, 47. Rails integrally extend from the back face of the heat shields 40 to strengthen the heat shields and direct the flow of cooling air as desired. Some of the rails may extend from the heat shield panel back face all the way into sealing contact with the inner surface of the combustor dome portion 24 and, thus, more or less act as sealing rails to compartmentalize the air gap 60, thereby directing the cooling air to targeted regions of the dome heat shields.

For instance, the rails may include lateral rails 66*a*, 66*b* extending along lateral edges 45, 47 between radially inner and outer rails 66*c*, 66*d*. These peripheral rails 66*a*, 66*b*, 66*c*, 66*d* form a closed perimeter at the back of the heat shield 40. The peripheral rails 66*a*, 66*b*, 66*c*, 66*d* extend across the air gap 60 into sealing contact with the inner surface of the dome portion 24 of the combustor 16.

The rails may also include concentric inner and outer rings 66*e*, 66*f* about each fuel nozzle opening 52. As can be appreciated from FIG. 3, the height of the inner rings 66*e* is less than the height of the outer rings 66*f* and the peripheral rails 66*a*, 66*b*, 66*c*, 66*d*. The rings 66*e* do not extend completely across the gap 60. As shown in FIG. 3, the inner rings 66*e* seal against the floating collars 54. Each pair of inner and outer rings 66*e*, 66*f* subdivides the air gap 60 into a collar cavity 60*a*. As shown in FIG. 3, cooling air A1 passes through a gap between the floating collar 54 and the outer shell 20*b* to cool each collar cavity 60*a* of the dome heat shield 40. Impingement cooling is not available in this area in view of the presence of the fuel nozzles 28 and the floating collars 54. A circular row of effusion holes 61 may be provided in the annular collar cavity 60*a* concentrically about each fuel nozzle opening 52 for allowing at least part of the coolant air flowing into the collar cavity 60*a* to flow thought the dome heat shield 40 to provide for the formation of a cooling film over the front face of the dome heat shield 40. Such dual use of the coolant air advantageously contributes to minimize the amount of cooling air required for the heat shields 40.

As shown in FIG. 4, an anti-rotation notch 70 is defined in each outer ring 66*f* for engagement with a corresponding anti-rotation tab 72 projecting from each floating collar 54. While in the example depicted the anti-rotation tab is on a floating collar, the skilled reader will appreciate that the described structure can be applied to anti-rotation feature(s) on any suitable adjacent structure. Coolant air in each collar cavity 60*a* can leak through the gap between the anti-rotation notch 70, the outer shell 20*b* and the anti-rotation tab 72. This leakage air is undesirable in that it weakens the impingement cooling of air passing through the inner and outer shell impingement holes 29 (FIG. 3) used to cool the main surface area of the dome heat shield outside the collar cavity area.

Figure 6:
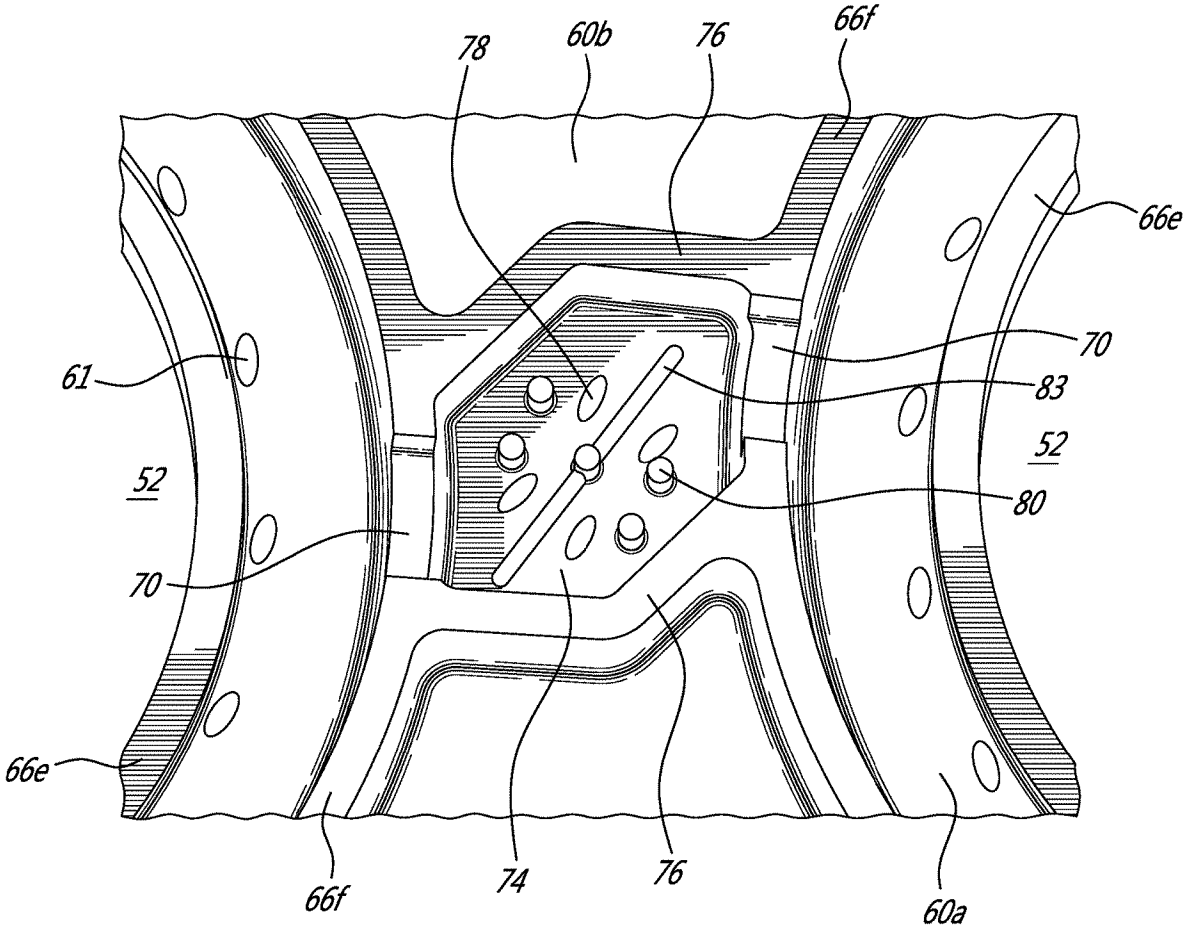
FIG. 6 is a rear enlarged view of the dome heat shield illustrating a notch cavity defined between notch cavity rails extending between outer rings projecting from the back face of the dome heat shield.

The detrimental effect of the collar cavity leakage air on impingement cooling of the remainder of the dome heat shield can be minimized by capturing at least a portion of the air escaping through the anti-rotation notch 70 into a notch cavity 74. As shown in FIG. 4, the notch cavity 74 may be formed by the addition of notch cavity rails 76 between the outer rings 66*f*. According to the embodiment shown in FIG. 4, the notch cavity rails 76 extend from a first outer ring to a second outer ring on either side of the anti-rotation notches 70 formed in the outer rings 66*f*. Accordingly, both anti-rotation notches 70 lead to a common notch cavity. In other words, both anti-rotation notches 70 are connected in fluid flow communication with a same and unique notch cavity 74. Effusion holes 78 may be provided in the bottom of the notch cavity 74 to evacuate coolant air from the notch cavity 74 and contribute to the formation of a cooling film of air over the front face of the dome heat shield 40. As shown in FIG. 6, heat transfer augmentation features, such as pins 80 and trip-strips 83 may be provided in the notch cavity 74.

The outer ring 66*f*, the peripheral rails 66*a*, 66*b*, 66*c* and 66*d* and the notch cavity rails 76 are in sealing contact with the outer shell 20*b*. This contact is however not perfect and coolant air can leak over the top of these rails as schematically depicted by the flow arrows in FIG. 5. It is, thus, desirable to minimize the length of the notch cavity rails 76 in order to reduce the air leakage from the notch cavity 74 to the main cavity 60*b* defined between the outer rings 66*f* and the peripheral rails 66*a*, 66*b*, 66*c*, 66*d*. The configuration of the notch cavity rails 76 extending transversally between the adjacent outer rings 66*f* from one anti-rotation notch to an opposed generally facing anti-rotation notch as for instance shown in FIG. 4 contributes to minimize the overall length of notch cavity rails 76.

Figure 7:
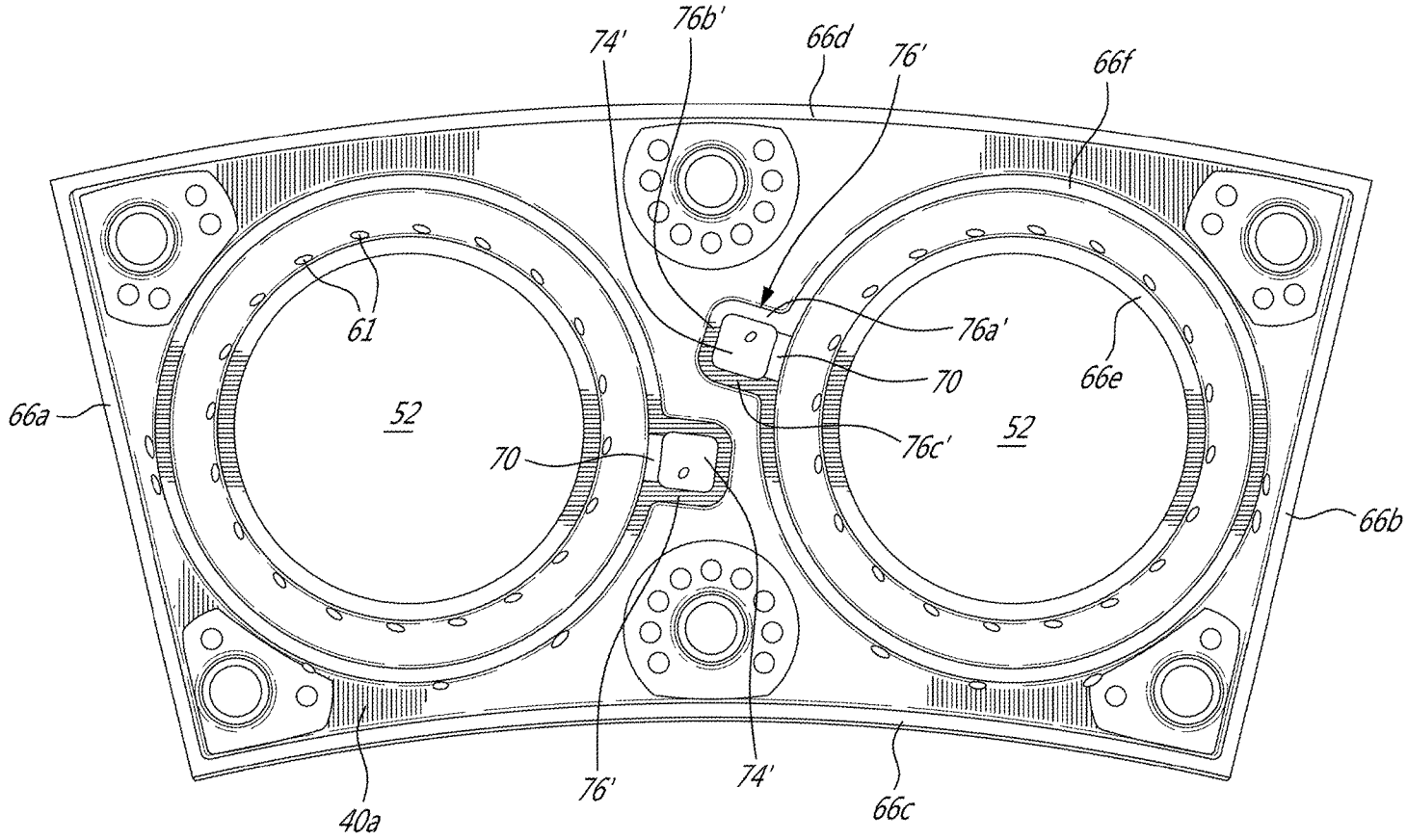
FIG. 7 is a rear view of a further embodiment of the dome heat shield wherein each anti-rotation notch has its own notch cavity.

Also, it is desirable to minimize the size of the notch cavities 74 and maximize the size of the main cavity 60*b* since the main cavity 60*b* can be impingement cooled efficiently through the shell impingement holes 29. As shown in FIG. 7, each anti-rotation notch 70 could have its own notch cavity 74'. According to this alternative, the notch cavity size is minimized but the length of the notch cavity rails is higher than in the embodiment shown in FIGS. 4-6.

This type of notch cavity is more suitable for dome heat shields having only one fuel nozzle per heat shield (i.e. dome heat shield with a single fuel nozzle opening and, thus, a single anti-rotation notch).

As shown in FIG. 7, the notch cavity rails 76' have a generally U-shaped configuration, including a first segment 76*a*' extending from the associated outer ring 66*f* on a first side of the anti-rotation notch, a second segment 76*b*' extending at generally 90 degrees from the first segment 76*a*' and a third segment 76*c*' extending at generally 90 degrees from the opposed end of the second segment 76*b*' to the outer ring 66*f* on a second side of the anti-rotation notch 70, thereby forming a closed perimeter at the exit of the anti-rotation notch 70.

The coolant air in the air gap 60 (i.e. the collar cavity 60*a*, the main cavity 60*b* and the notch cavities 74) can be discharged through the effusion holes 61 in the collar cavity 60*a*, the notch and main cavities 74 and 60*b*, as well as through holes (not shown) defined in the peripheral rails 66*a*, 66*b*, 66*c*, 66*d*.

The above description is meant to be exemplary only, and one skilled in the art will recognize that changes may be made to the embodiments described without departing from the scope of the invention disclosed. For example, the invention can be provided in any suitable heat shield configuration and in any suitable combustor configuration, and is not limited to application in turbofan engines. Also, the anti-rotation notches could be defined in other types of rails and are not limited to the outer rings as shown in the exemplified embodiments. For instance, the anti-rotation notches could be provided in semi-annular mid-rails extending between the inner and outer rails. Still other modifications which fall within the scope of the present invention will be apparent to those skilled in the art, in light of a review of this disclosure, and such modifications are intended to fall within the appended claims.

What is claim is:

1. A dome heat shield for a combustor of a gas turbine engine, comprising a heat shield panel adapted to be mounted to a combustor dome with a back face of the heat shield panel in spaced-apart facing relationship with an inner surface of the combustor dome to define an air gap between the heat shield panel and the combustor dome, rails extending from the back face of the heat shield panel across the air gap, and at least one anti-rotation notch defined in one of a first or second rail of the rails for receiving an anti-rotation tab of an adjacent element, the rails further including notch cavity rails extending from the first or second rails on either side of the at least one anti-rotation notch, at least one notch cavity defined by the notch cavity rails and in fluid flow communication with the at least one anti-rotation notch, the rails further including peripheral rails forming a closed perimeter on the back face of the heat shield panel, that define a boundary around said notch cavity rails, said at least one notch cavity, and said first and second rails; the dome heat shield further comprising first and second fuel nozzle openings defined in the heat shield panel, wherein said at least one anti-rotation notch includes first and second anti-rotation notches disposed in said respective first and second rails, and wherein said notch cavity rails connect both said first and second anti-rotation notches in fluid flow communication with at least one respective notch cavity.

2. The dome heat shield defined in claim 1, wherein the first and second rails respectively at least partly surround the first and second fuel nozzle openings.

3. The dome heat shield defined in claim 2, wherein the rails include inner and outer rings concentrically disposed about the first and second fuel nozzle openings, and wherein the first and second rails correspond to the outer rings.

4. The dome heat shield defined in claim 1, wherein said first and second rails include first and second rings respectively surrounding the first and second fuel nozzle openings, wherein said first and second anti-rotation notches are respectively defined in the first and second rings, and wherein said notch cavity rails extend from said first ring to said second ring.

5. The dome heat shield defined in claim 4, wherein said first and second rings are outer rings respectively extending about first and second inner rings, the first and second inner rings circumscribing the first and second fuel nozzle openings.

6. The dome heat shield defined in claim 1, wherein effusion holes extend through the heat shield panel within the confines of the at least one notch cavity.

7. The dome heat shield defined in claim 6, wherein heat transfer augmentation features are provided within the at least one notch cavity.

8. The dome heat shield defined in claim 7, wherein the heat transfer augmentation features include at least one of a set of pin fins and a set of trip-strips.

9. A gas turbine engine combustor comprising the dome heat shield as defined in claim 1.

10. A gas turbine engine combustor comprising: a shell having a dome, at least one dome heat shield mounted to an inner surface of the dome, first and second fuel nozzle openings defined in the at least one dome heat shield, first and second fuel nozzle components mounted to the dome, the first and second fuel nozzle components having respective anti-rotation tabs engaged in respective anti-rotation notches respectively defined in first and second rails extending from a back face of the at least one dome heat shield, the anti-rotation notches leading to at least one notch cavity defined on the back face of the at least one dome heat shield by notch cavity rails extending from the first and second rails, the notch cavity rails connecting the anti-rotation notches in fluid flow communication with the at least one notch cavity, and wherein peripheral rails form a closed perimeter on the back face of the dome heat shield and define a boundary around the notch cavity rails, the at least one notch cavity, and the first and second rails.

11. The gas turbine engine combustor defined in claim 10, wherein the first and second fuel nozzle components comprise at least one floating collar mounted between the dome and the at least one dome heat shield, the at least one floating collar having one of the anti-rotation tabs.

12. The gas turbine engine combustor defined in claim 11, wherein the at least one floating collar comprises first and second floating collars, the anti-rotation tab of the first floating collar being engaged in the anti-rotation notch of the first rail, the anti-rotation tab of the second floating collar being engaged in the anti-rotation notch of the second rail, and wherein the notch cavity rails extend from said first rail to said second rail, the anti-rotation notches of the first and second rails both leading to said at least one notch cavity.

13. The gas turbine engine combustor defined in claim 10, wherein effusion holes extend from the back face to a front face of the at least one dome heat shield within the confines of the at least one notch cavity.

14. The gas turbine engine combustor defined in claim 10, wherein pins and/or trip-strips are provided within the at least one notch cavity.

15. The gas turbine engine combustor defined in claim 12, wherein the first and second rails are provided in the form of annular rails respectively surrounding the first and second fuel nozzle openings, said annular rails defining an annular collar cavity about each of the first and second fuel nozzle openings, said annular collar cavities being connected in flow communication with the at least one notch cavity via the anti-rotation notches.

* * * * *